US006656046B1

(12) United States Patent
Yoseloff et al.

(10) Patent No.: US 6,656,046 B1
(45) Date of Patent: Dec. 2, 2003

(54) REEL OR VIDEO REEL GAMING FORMAT

(75) Inventors: Mark L. Yoseloff, Henderson, NV (US); Russell Brooke Dunn, Henderson, NV (US)

(73) Assignee: Shuffle Master, Inc., Eden Prairie, MN (US)

( * ) Notice: Subject to any disclaimer, the term of this patent is extended or adjusted under 35 U.S.C. 154(b) by 238 days.

(21) Appl. No.: 09/326,934

(22) Filed: Jun. 7, 1999

(51) Int. Cl.[7] ..... A63F 9/24

(52) U.S. Cl. ..... 463/20; 463/16; 463/17; 463/35

(58) Field of Search ..... 273/143 R; 463/16–22, 463/30, 35

(56) References Cited

U.S. PATENT DOCUMENTS

| | | | | | |
|---|---|---|---|---|---|
| 4,138,114 | A | * | 2/1979 | Anderson | 273/143 R |
| 4,448,419 | A | | 5/1984 | Telnaes | 273/143 R |
| 4,573,681 | A | | 3/1986 | Okada | 273/143 R |
| 4,700,948 | A | | 10/1987 | Okada et al. | 273/143 R |
| 5,135,224 | A | * | 8/1992 | Yamamoto et al. | 273/143 R |
| 5,393,057 | A | * | 2/1995 | Marnell, II | 273/85 CP |
| RE35,188 | E | * | 3/1996 | Howard | 273/143 R |
| 5,664,999 | A | * | 9/1997 | Kurihara | 463/20 |
| 5,695,188 | A | * | 12/1997 | Ishibashi | 273/143 R |
| 5,772,509 | A | | 6/1998 | Weiss | 463/13 |
| 5,779,544 | A | * | 7/1998 | Seelig et al. | 463/6 |
| 5,848,932 | A | * | 12/1998 | Adams | 463/20 |
| 5,908,354 | A | * | 6/1999 | Okuniewicz | 463/35 |
| 5,927,714 | A | * | 7/1999 | Kaplan | 273/143 R |
| 5,971,849 | A | * | 10/1999 | Falciglia | 463/16 |
| 5,980,384 | A | * | 11/1999 | Barrie | 463/16 |
| 6,012,982 | A | * | 1/2000 | Piechowiak et al. | 463/16 |
| 6,047,963 | A | * | 4/2000 | Pierce et al. | 273/121 B |

FOREIGN PATENT DOCUMENTS

GB 2 222 712 A * 3/1990

OTHER PUBLICATIONS

"Elvis is in the Building", *Slot Line—News of the Gaming World*, Product Brochure published by International Gaming Technology, 1–6, (Winter 1999).

"Elvis' Tops the Charts of New IGT Hits" on p. 2 of *Slot Line—News of the Gaming World* of the Product Brochure published by International Game Technology, 12 pages, (Publication date prior to the filing date of the present invention).

"The Return of the King", *Strictly Slots*, 1 page, (Feb., 1999).

* cited by examiner

*Primary Examiner*—S. Thomas Hughes
*Assistant Examiner*—Carmen D. White
(74) *Attorney, Agent, or Firm*—Mark A. Litman & Assoc. P.A.

(57) ABSTRACT

A reel slot casino wagering apparatus comprises a housing having at least three displayed reels thereon, each reel having symbols, characters or alphanumerics that are displayed, a wager entering system, a CPU and a sound system. The CPU has software and/or hardware that provides distinctly different audio signals for at least one of 1) availability of the apparatus to start a new wagering game, 2) presence of bet credits, 3) amount of bet credits available, 4) number or amount of bet credits wagered or coins or token wagered, 5) revelation of a non-payout configuration, 6) position of only particular symbols where the total configuration of all symbols does not provide a payout, 7) size of a payout inclusive of payouts for non-jackpot awards, 8) denomination of currency or credits deposited, and 9) denoting one or more game losses.

10 Claims, 6 Drawing Sheets

REEL OR VIDEO REEL GAMING FORMAT

BACKGROUND OF THE INVENTION

1. Field of the Invention

The present invention relates to video gaming, visual aspects of video game displays, formatting of video games, new methods and apparatus for providing interchangeable formatting for different games, methods and apparatus for providing ease of reconfiguring thematic changes in a video game with reduced reprogramming needs, and novel sensory features associated with video games and video game apparatus.

2. Background of the Art

Video gaming is a form of entertainment involving the display of the format of a game on a video screen (presently on a cathode ray tube or monitor, liquid crystal display screen or any other visually observable image presenting system) and the interaction of a player(s) with data flow displayed on a screen. The player(s) may place wagers on the outcome of various statistically driven games which are displayed on the screen. Originally, the mechanical forerunners of video games were primarily limited to games having symbols displayed on reels, each symbol occupying a frame on the wheel, and the wheels being spun and then stopped to display a line of symbols (usually three symbols in a single row). Payouts were provided for certain specific symbol combinations on the payout line. Certain symbols became traditional on mechanical gaming machines (e.g., slot machines) such as the number "7," cherries, bells, oranges, lemons, plums, etc. Over time, less traditional symbols were added to give the game a different visual appearance, but the play of the reel oriented slot machine game remained essentially the same.

When video gaming was first introduced to the gaming world, the first video games were electronic imitations of the traditional slot machines, even using the same symbols, and the same physical formats (e.g., a handle to initiate play), assuring that the transition from mechanical to electronic formats would meet the least resistance. As electronic gaming became more accepted, both the formats (e.g., buttons versus handles) and the game content (e.g., poker games, dominoes, keno, blackjack, Bingo, Pai Gow poker, etc.) were changed and expanded. The format of play within the electronic or virtual reel games has also progressed from the early duplications of the mechanical reels on a visual screen. The flexibility afforded the games by the use of computers, printed circuit boards, virtual images, and the high information density and volumes that can be used with electronic media, has enabled essentially unlimited formatting and image capability in the equipment. However, even with this potential, very little has been done with virtual reel games. The most notable product introductions in the virtual reel industry have included multiple payout lines on the displayed reels (e.g., payouts allowed on three rows when three tokens are played), multiple payout formats (e.g., payouts in rows, columns, diagonals, and/or patterns), and the imagery of the frames (e.g., different symbols, different themes for the symbols, and even animated movement within the frames of the symbols).

The various changes that have been and may be made in the virtual reel video systems may be characterized within three types of change classes: 1) changes that affect the probability of the awards; 2) changes that affect the fundamental nature of the game; and 3) changes that provide an entertainment or aesthetic variation to the game. Examples of changes that would affect the probability of awards would include, for example, selecting the total number of symbols within any reel or reels, selecting the number of any specific symbol within a reel or reels, selecting the number of lines or patterns for which there will be payouts, and the like. Examples of changes that would affect the fundamental nature of the game include, for example, the ability to retain a symbol on one or more reels from a first play and then re-spin remaining reel(s), the ability of a machine or player to 'nudge' a frame within one reel to a more favorable position, and the like. Examples of changes that would provide an entertainment or aesthetic variation to the game would include, for example, variations in artwork in the frames, variations in themes in the frames or in the background of the frames, and the like. Some of the more striking artwork renditions now include, for example, animation, such as faces on the symbols which alter their orientation (e.g., turn within the frame and look at another character), alter their expression (e.g., smile or frown or laugh), or otherwise provide a different image within the frame.

In a majority of video gaming devices, however, the imagery generally is still provided by reels (virtual or actual) that give the appearance of rotating in place, with the reels providing for entire columns, entire rows, or individual frames. It is always desirable within an entertainment field, such as video gaming, to be able to provide variations in the play and appearance of games to attract and maintain players.

The apparatus used for video gaming normally comprises:

- a reel mounted for rotation about an axis through a predetermined number of radial positions;
- a motivation system to start rotation of said reel about said axis;
- indicia fixed to the reel to indicate the angular rotational position of the reel;
- various angular rotational positions of said reel having assigned thereto symbols, characters, or alphanumerics. There is usually a plurality of such said plurality of symbols exceeding said predetermined number of radial positions such that some rotational positions are represented by a plurality of symbols, characters, or alphanumerics assigned to each reel and even to each position on a virtual reel of the apparatus;
- the apparatus randomly selects one of the plurality of assigned symbols, characters, or alphanumerics; and
- the apparatus stops the reel at the angular position represented by a selected symbol(s), character(s), or alphanumeric(s).

U.S. Pat. No. 4,573,681 describes a slot machine is provided which has a winning probability table for storing a relation between a group of symbols and random numbers, the group being one of a plurality of groups made up by classifying prize-winning symbols. The range of random numbers is properly fixed so that the winning probability is determined. Prior to the start of a game, one of the random numbers is sampled from a plurality of random numbers. The decisions on whether there is a win or not, and on which group the sampled random number belongs to if there is a win, are made with reference to the winning probability table. A hit request signal is generated for the latter decision. The hits are of different sizes, that is to say that different hits pay different numbers of wins. The larger the hit, the fewer random numbers correspond to it. The stopping series of symbols is controlled in accordance with the hit request signal. The patent also describes the use of "A sound generator 55 drives a loudspeaker 56 to generate a sound therefrom after a suitable time lapse from the start of a game, so that playing the game becomes more interesting." There is no specific disclosure of any relevance of the sound to functions of the apparatus.

There is also a desire in the industry to enable usage of gaming apparatus by all portions of society, including the visually impaired, while providing significant entertainment for all players in what is clearly a highly visual format.

A number of factors have contributed to the popularity of video wagering games. Gaming establishments have expanded the variety of games offered on video platforms beyond what was once limited to video poker, video keno and video reel slot machines. Many casino table games such as blackjack, draw poker, stud poker, Let It Ride® stud poker and Caribbean Stud Poker® are available on video. These games can be learned on video machines before advancing to the more intimidating live table game environment. With video wagering, novice players can enjoy playing a wide variety of casino games without having to play at a table with other more experienced players who may create an intimidating environment for the novice. Players of video games need not worry about playing too slowly to suit the dealer or other players or about feeling embarrassed by making a particular strategic decision.

Video wagering games often are capable of paying a progressive jackpot if the player achieves a predetermined winning outcome, which offers the anticipation or hope for a very large award. For the above reasons, the video wagering format is growing at a pace which exceeds the growth of play of live casino table games and other types of live wagering.

Some video games which are adapted for play on a home computer have a "second screen" feature. That is, if the player wins a certain number of games, or achieves a predetermined skill level in a game, a second screen will appear which either permits the player to play the same game at a higher skill level or allows the player to engage in a special feature of that game (e.g., collect additional game pieces or 'lives' in Mario Brothers®). In the case of video wagering, there are also a number of recently introduced video wagering games which provide an opportunity to first play an underlying or principal video wagering game (e.g., draw poker) and then to play a different wagering game, although on the same video screen format as the poker game (e.g., as with "double down" games described herein).

A video wagering game with a "second screen" feature is disclosed in copending U.S. patent application Ser. No. 08/820,438, filed Mar. 12, 1997 for a "Method of Scoring a Video Wagering Game," now U.S. Pat. No. 6,179,711, issued Jan. 30, 2001, the disclosure of which is herein incorporated in its entirety by reference thereto.

For example, some video poker games offer a double-or-nothing feature. If a player has a winning hand in the first segment of the game, the player can optionally risk the amount won by trying to determine whether a given card will be higher or lower than 8. Alternatively the player may have to choose one of four cards in an attempt to get a card higher than one already shown. If the player wins, his original bet is doubled. He may continue to "double up" until he reaches some predetermined limit, or loses. However, if he loses, he loses the winnings from the first game. This "double up" game is played on substantially the identically formatted screen (showing five playing cards, but with the possible addition to that screen of alphanumerics, as later described) as is the underlying poker game. The principal game, the poker game, is played to obtain an award, and only that award allows winnings from that single game to be "doubled up." There also exist video wagering games that have a video slot segment and at least one additional video wagering segment. Additionally, there are known second, that is, alternative screen games in which the winnings from the second screen game are unrelated to and independent of the winnings in the first screen game.

SUMMARY OF THE INVENTION

Slot machines are gaming devices which originally incorporated a plurality of reels rotatable about a common axis and on which are carried at the periphery a plurality of indicia indicating the position each reel stops. Usually the reels are set into motion by pulling a lever and upon stopping, the angular positions of the reels are detected to determine the amount of payoff to the player. With physical reels, buttons may now be used to initiate and stop spinning of the reels to reduce stress on the arms of players. The gaming devices can also be programmed to automatically spin upon placing a wager, and automatically stop, without the player having to manipulate player controls.

In the original mechanical machines the reels were stopped by actuating a brake or a tripping arm/pin which moved into grooves (cutouts) in each reel's index wheel on a random timing basis. This method was carried over to the electromechanical machines of the 1960's as the basic stopping of the reels was by timewise releasing an index pin into grooves in index wheels attached to the reels with indicia displaying the game result. These varying depth grooves enabled, via physical contact closures of wipers being a part of the index arm mechanism and physical wiring to relay logic, payouts in accordance with the designed payout schedule which again was directly related to the probability of occurrence of the indicia—symbol—displayed on the reel itself. Such machines are directly susceptible to wear and tear (including erroneous electrical paths due to dirt and coin dust in particular, in the wiper contact area) as well as intentional tampering by both the player and unethical operators and their employees in violation of the regulations required for randomly probabilistic payoff.

Now electromechanical gaming devices are employed with a plurality of reels rotatable about a common axis and set into rotation by the pulling of a lever, by depressing a button, or automatically when the maximum amount for wagers has been wagered. However, even in these relatively newer devices, an electronic random number generator of some type is energized which generates one number corresponding to each of the various positions at which the reels can be stopped. As the game is played, each reel is stopped in sequence with the other reels at a position corresponding to each subsequent number generated. The angular rotational positions of the reels are detected at all times and the brake is engaged when the reel position corresponds to the random number generated for that reel. The probability for paying off on a combination of indicia on presently used machines, as described above, is dependent on the number of reels, the number of different angular rotational positions at which the reels can be stopped, and the number of winning combinations of indicia. In other words, the lowest probability for payoff that can be offered on presently used machines are 1 to $N^R$ where N is the number of angular rotational positions on each reel and R is the number of reels. Thus, for a three reel machine having 20 stop or index positions on each reel, the lowest probability that can be offered is $1:20^3$ or 1:8000. For a machine to be commercially viable, there is a limit on the largest amount that will be paid for any such single indicia combination.

The above reasoning explains why the slot machines which offer greatly increased payoffs are usually very large machines in terms of the number of reels and stop positions. The large machine provides the physical size to allow an increase in the number of reel stop positions as well as number of reels to increase the probability against payoff on any one position.

It should be noted that the market demands higher and higher payoffs to maintain and increase player appeal, yet the casino or operator must be assured that the probability of win and payout allows for a reasonable business profit. Generally the profit-hold objectives before taxes and operational costs that are deducted are in the range as low as 2.7% and generally up to 15%. Hence, the higher payoff for a winning indicia combination must be counterbalanced with a lower probability for the high win combination of indicia. The introduction of video slot machines and CPUs has enabled the use of random number generators in combination with the virtual reels used, as in U.S. Pat. No. 4,448,419. The full capacity of CPUs have not yet been used in the play of video wagering games or in combination with physical reel slot machines. The term "physical reel slot machine" denotes the use of an actual physical reel with symbols, characters, or alphanumerics associated with the play of a wagering game.

Reel slot games or virtual reel slot games are provided with enhanced playing features by the use of novel formatting or display aspects on the reels or screen and sound system of the wagering apparatus. One aspect of visual enhancement of reels or virtual reels is the use of a border on the reels or virtual reels that simulates a thematic border around each frame or the majority of frames, particularly a border that emulates or duplicates the appearance of motion picture framing. An enhanced visual appearance is provided to each or certain frames in a reel or virtual reel by the use of a border on frames that has the appearance of the black edging (e.g., with sprocket holes, black sides, black spacing between frames, pictures in the frames, etc.). By providing frames with defined characters or symbols in the frames for winning outcomes, thematic changes may be made in the wagering apparatus by merely altering the specific thematic characters or symbols in the frames without the need of reprogramming the complere reel probabilities, appearance or the game. For example, a three reel (or three virtual reel) slot machine wagering game may be provided with a thematic format of the Three Stooges (with combinations of Curly, Larry, Moe, and Shemp), and the format may be changed to the Marx Brothers (with combinations of Chico, Harpo, Groucho, and Zeppo) simply by replacing the images in the frames, along with other optional modifications of the imagery or audio displays associated with the game. Special sound effects may be provided with the feeding of different denominations of currency or wagers into the machine or the wagering of different values of individual game wagers, with different sounds for the feeding currency or the wagering of 1, 2, 3, 4 and 5 or more coins, tokens or units.

Another aspect of the present invention includes a method of playing a video wagering game in which there are two distinct video components to either a) at least two distinct games with different video formats played in sequence or b) a single, multi-event game with at least two different video formats, in which at least a portion of the awards or winnings from a first game or event may be or must be carried forward into the second game or the second event. The game includes at least a first and second wagering segment. For purposes of this disclosure, a "segment" is a video wagering game which is capable of being played as a stand alone game (e.g., with a wager and possible outcomes which include the loss of all or a part of a wager, return of an amount equal to the wager, or an award of an amount greater than the initial wager). In the practice of the present invention, at least two of these segments are associated in an order (which order may be consistent or variable over continued play of the game, that is, given segments A, B, C and D, the segments may be played in any order in consecutive games, such as A, B, C and D; B, C, D and A, C, B, A and D; D, A, C and B, etc.). For example, either the player or the video gaming apparatus may select an order of games of poker, dominoes and blackjack; blackjack, dominoes and poker; or dominoes, poker and blackjack.

The method comprises the steps of placing a wager to participate in a video wagering game, playing a first segment of the video wagering game, and continuing to play the first segment of the video wagering game until at least one predetermined condition has been met and for which predetermined condition an award is made to the player. Preferably, there may be more than one predetermined condition which enables the player to advance from the first segment of the video wagering game to another segment. The predetermined outcomes may include, for example, achieving a predetermined number of winning outcomes or achieving one of a specific or general group of winning outcomes. The term "predetermined" in the practice of the present invention does not, as previously understood in the art, limit the outcome to earlier identified item specific outcomes. That is, in the prior art, the term "predetermined outcome" would earlier identify hand distributions that would mean, in poker for example, a particular type of playing hand such as a straight, flush, full house, four of a kind, straight flush, etc.

In the play of the generally preferred aspects of the invention, again using the film strip format of the Three Stooges as an example, play could include the three or more reels (virtual or physical) with possible winning combinations of images including images including pictures or caricatures of individual or collective Stooges, as well as other numbers, symbols or characters that can be combined to provide winning combinations, but not necessarily bonus or jackpot combinations. It would also be desirable to identify the special "bonus" feature characters, as by including a bar with the figures that says "bonus" or some other special identifier (including sounds as later described). Alternatively, the second game segment could be activated by a game symbol or game outcome which is not a part of or is not a winning outcome. A plasma screen, independent of single video apparatus at each player's position, but associated with a bank of individual video apparatus, could be used to show the play of the bonus feature.

One condition that may be imposed, and would usually be imposed, for playing the second segment is to have a winning outcome and an associated payout assigned for the first segment at the time or before the time when the second segment is played. In one example of the invention, once the predetermined condition or conditions have been met, the player must play the second segment of the wagering game using at least a portion of the payout as a wager in the second segment. The second segment may even constitute a separate game which requires a separate wager. This is substantively different from games such as Double-Down Stud following draw poker where the player has an absolute right of election to play the Double-Down Stud game, either none of the winnings or all of the winnings are usually required, and the screen format remains the same. The second segment in the present invention may even constitute a game which allows the second wager to be completely lost, places only a portion of the wager at risk, or guarantees at least a return of the wager on the second segment, with a possibility of an increased award (by addition or multiplication of the award achieved on the play of the first segment wager game). In another example of the present invention, a player can optionally choose to participate in the second segment of the game, and is required to put all or part of an award earned in the first segment at risk. Every outcome of the second segment may have a factor associated with it which enhances the payout of the first segment, e.g., by multiplying the original payout by the factor. According to one method of practice of the present invention, the minimum factor in the second segment could be one. The player in that instance is therefore guaranteed a payout at least as great as the original payout, and hence does not risk the payout awarded in the first segment by playing the second segment of the game. Additionally, one or several predetermined outcomes of the second segment may be assigned fixed or progressive jackpots, yielding even larger winnings for the player.

DETAILED DESCRIPTION OF THE INVENTION

Figure 1:
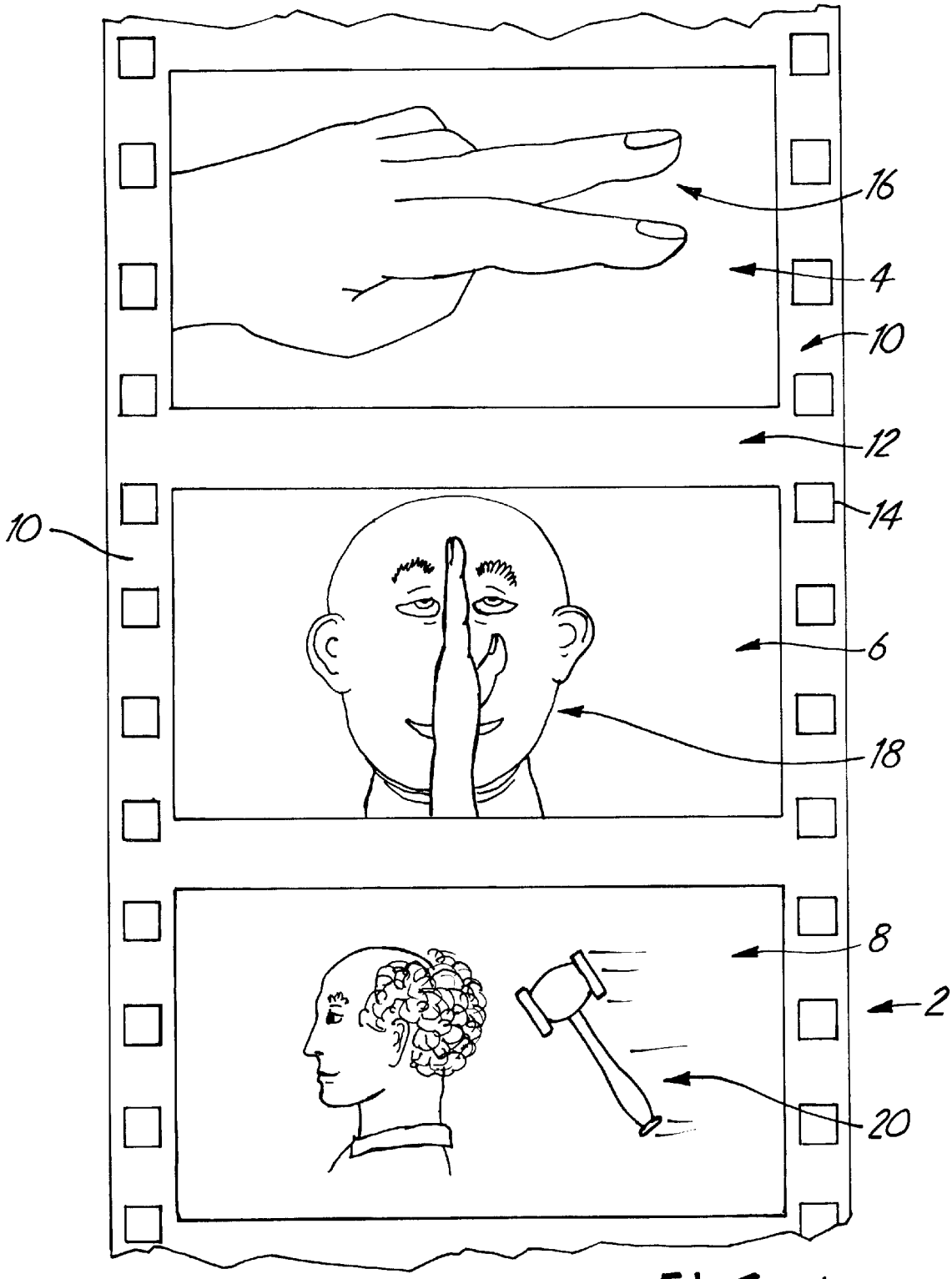
FIG. 1 shows a section of a continuous reel or virtual reel.

One significant economic consideration in the use of a gaming apparatus, and particularly both the reel slot games and the virtual reel (video) slot games is the fact that many games have a finite player acceptance life. Slot games are fairly regularly replaced with new games, particularly new games with different themes. Players enjoy the environmental variations of different symbols, different sounds, and different themes that can be provided with such wagering games. Even where the underlying play of the game may not vary, changes in the visual and audio aspects of the wagering game maintain or increase player interest in wagering. Upgrading or replacing formats in a wagering apparatus is neither a trivial matter or an inexpensive effort. The change from one format to another might include changing the console and housing for the apparatus, changing the artwork on the console and housing, changing the artwork on the reels, changing the audio display for winning events, and changing the probabilities for winning outcomes. Many of these changes are expensive, and many times the older apparatus is merely consigned to second tier wagering establishments, sold on the private market or destroyed. Because of the potentially short entertainment life of individual wagering games used on wagering apparatus, this replacement cycle can become a very high expense factor in the gaming industry.

Reels and virtual reels are provided with borders around or surrounding each area that can be displayed within the display area of a slot machine. The artwork of the borders may be thematic in nature (e.g., picture frames, scroll work, window frames, trains or train window frames, airplane windows, port holes, and especially motion picture frames provided separately or in the appearance of a continuous film strip). Individual symbols or characters may be provided within the frames. A relative probability of occurrence is established (based on random occurrence) or is programmed for each symbol or character. The characters or symbols within the frames may be altered to reformat the theme of the game, without necessarily having to completely refurbish the apparatus, the probabilities, the rules of the game or any other associated features. Among the optional but possible changes that could be made in the apparatus, yet still reducing the recycling costs for altering the thematic format of the apparatus include, for example only, having a replaceable overlay on the console or housing of the apparatus that can be replaced without having to completely disassemble the gaming apparatus, having replaceable reels, having replaceable audio chip(s), having a replaceable overlay for the reels, having software that allows for the imagery within the frames to be replaced without the necessity of altering other aspects of the software, and the like. Each of these features will be explained in greater detail, with the visual formatting of motion picture themes and artwork used as a preferred, but non-limiting example for the discussion.

FIG. 1 shows a section of a continuous reel or virtual reel 2. Three frames 4, 6 and 8 are shown on the reel 2. Each frame 4, 6 and 8 is shown with the edges 10 on the sides of the frames 4, 6 and 8. The edges 10 are shown with the image of sprocket openings 14 included within the edges 10. The edges 10 and the separation strips 12 are usually provided in black, which is typical for motion picture film strips. Different, thematically related images are provided, one in each of the three frames 4, 6 and 8. In keeping a thematic uniformity with the Three Stooges, frame 4 shows an image of Moe's two fingers 16, usually used to poke one of the other Stooges in the eyes. Frame 6 shows an image of Curly with a hand held in a defensive position to prevent Moe from poking him in the eyes 18. Frame 8 shows a hammer about to strike Larry in the back of the head 20. These image symbols or pictures or representation of characters may optionally be interspersed with conventional reel images (sevens, bars, fruit, bells,) or non-conventional symbols or images. Primary, underlying reels or software for the virtual reels may be provided by a manufacturer.

One aspect of the present invention provides for the use of visually apparent borders around each symbol containing frame (and optionally around blank areas on the reels) to clearly locally define the frame. Probabilities for the occurrence of each frame appearing in the visually revelations of the apparatus or video screen are either inherently provided (random) or programmed or preset. Where a video gaming system is being used, the software associated with a computer or CPU or chip may provide imagery of the film strip moving the frames along. The underlying software may provide imagery of only the blank frames moving across or up and down the screen in a scrolling manner. Another segment of the software may provide imagery of the symbols or characters in the frames. This second segment of the software may be all that is needed to be replaced in changing thematic formats for the wagering apparatus. Individual frames may be assigned specific frequencies in the video, computer generated system, and in changing from one thematic format to another, only that second segment with the upgraded or changed imagery needs to be changed. Creating software that is responsible for generating reuseable images advantageously reduces the development cost of programming new games having similar visual appearance and formats.

Where a reel slot machine is being used, only the images on the physical reels need to be changed. The change of the actual reels or the image within frames within the reels may be all that is needed to maintain an underlying thematic continuity (e.g., motion pictures) while altering the superficial theme (e.g., from the Three Stooges to the Marx Brothers). For example, the console and/or housing of the gaming device may have the appearance of an old fashioned motion picture camera, with the handle (functional or not) appearing like the old winding handle on a motion picture camera. The reel imagery of the motion picture film strip would be maintained, with the imagery within the frames altered. This alteration on a physical reel could be effected in a number of ways. The entire reel(s) could be replaced, individual image frames could be removed from between the edges and the spacing line, a continuous overlay edge and spacing line element could be temporarily removed from the reel and replacement imagery placed under the overlay that is then replaced, and the like. The probability of the payout in a game would not necessarily be altered if symbols of equivalent probabilities of occurrence and non-payout symbols were replaced on each of the reels. For example, if there were a first reel or virtual reel with only one Moe, a second reel or virtual reel with three Curly's, and a third reel or virtual reel with two Larry's, the probability or frequency of a winning outcome of Moe, Curly and Larry would not be altered in reformatting the game to provide a first reel or virtual reel with only one Harpo, a second reel or virtual reel with three Chico's, and a third reel or virtual reel with two Groucho's. The frequency of a winning outcome would be altered by adjusting the symbols/character and the probability/frequency of any particular character being shown on a pay line. One aspect of the invention with regard to a computer or CPU controlled gaming apparatus would therefore include providing at least one segment of software of a visual format that defines frames, each frame having an assigned probability of occurrence for display on a video screen along a pay line, providing at least a second segment of software of a visual object that is to be displayed within said at least one segment of software, and displaying the visual object of the second segment of software in a frame associated with that second segment of software. The overall visual format of the apparatus may be changed by at least substituting new software for only the second segment of software so that a new visual image is to be displayed in a frame associated with the second segment of software when that frame is selected to appear on a pay line. Alternatively, the first segment creates a visual image of the boundaries of each reel position, but the segments are not assigned a probability of occurrence.

Figure 2:
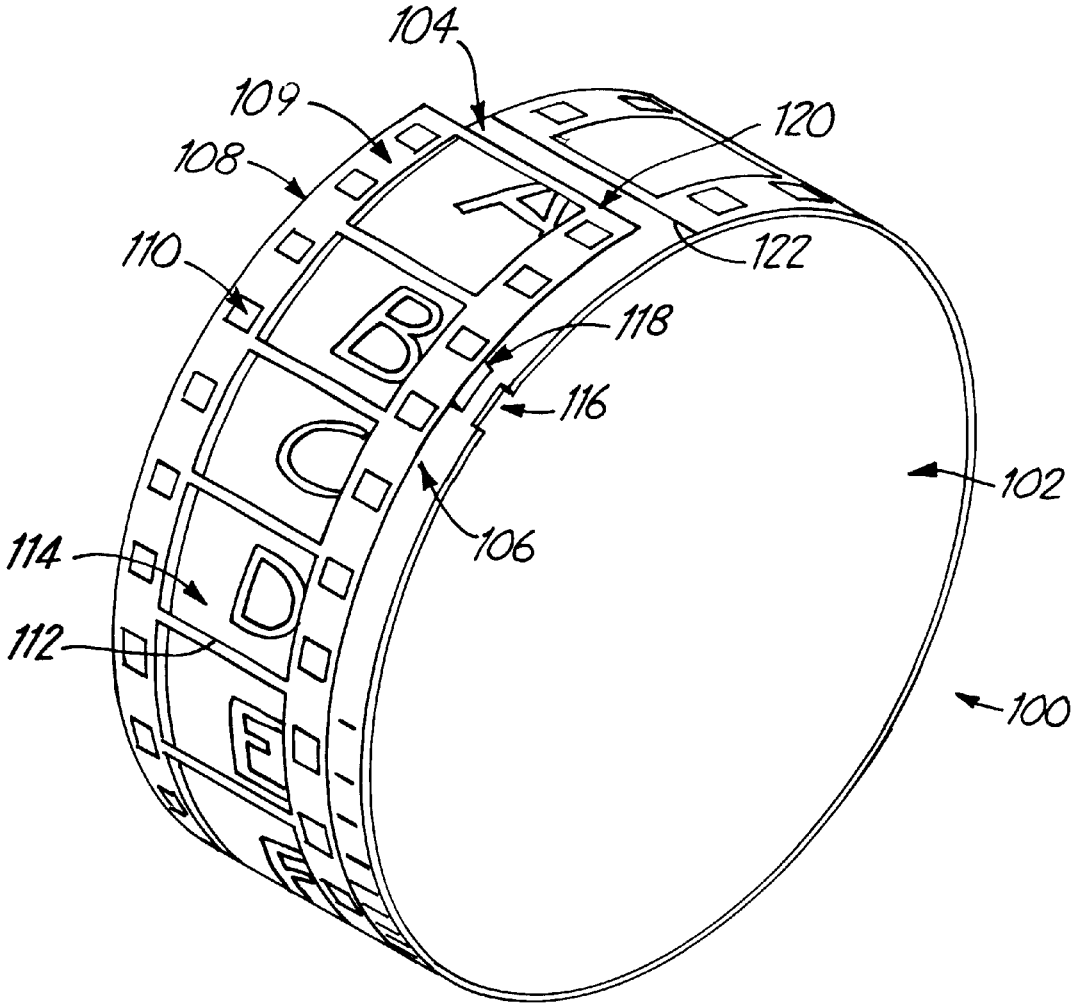
FIG. 2 shows one embodiment of a reel that may be used in the practice of the invention.

In a normal reel slot game, the reel may be structured to enable ease of physical replacement for the symbols and characters. FIG. 2 shows one embodiment of this aspect of the invention. A reel system 100 is shown having a central core 102 with a printed polymeric or metal film 104 adhered to the core 102. Indicia, alphanumerics, figures or characters 106 are printed or attached to the film 104. A retaining overlay 108 assists in securing the film 104 to the core 102. The overlay comprises edges 109 with sprocket holes 110 painted or cut therein. Separation strips 112 and open frame areas 114 are also present on the overlay 108. The overlay 108 is secured (removably) to the core 102 and the film 104. Any securement means may be used, such as physical attachment or adhesive attachment or magnetic attachment. FIG. 2 shows receptor holes 116 into which tabs 118 on the overlay 108 are inserted and secured. Ends 120 and 122 abut each other when the overlay 108 is fully secured and lays flat against the overlay 108. The overlay 108 may be completely removed from the core 102 and the film 104 replaced. Unless individual reel positions of the core have been assigned distinct probabilities, it will be only the random, inherent probabilities of the number of particular symbols and total symbols on the film 104 that will determine the frequency of individual symbol or character outcomes. It is equally possible to replace an entire reel with the symbols and/or characters printed thereon, rather than replacing only the film 104.

It is another aspect of the play of the present invention to provide a unique format for the play of the present game. The game may be formatted as a bank of more than one individual playing station or monitor, linked with a common display area. For example, a bank of 2, 3, 4, 5, 6, and individual numbers up to 100 or more video gaming apparatuses may be associated with the play of this game. Each individual reel slot game (either a physical reel or video reel) will be able to play the underlying game. Each individual station will have the reel system (physical or virtual) and may have a monitor present to assist the player in having information on the play of the game. The monitor and the associated CPU, hardware and/or software can provide functions inclusive of game status information, wagering information, credits, entertainment elements, entertainment awards, and the like. Associated with the bank of stations can be a large screen display (e.g., CRT, refletion screen, projection screen, LCD, or plasma screen for the display of a feature to a larger segment of the play of a bonus feature or an entertainment feature. For example, the play of the game may proceed as follows, with as a non-limiting example, eight or ten separate player stations being associated together. Each player plays at a distinct station or reel slot machine. When a bonus play alignment or award is attained, the player advances to the bonus play. This may be accompanied by a notice or first entertainment segment displayed on an individual monitor or display associated with the individual player. There is then a bonus play display, which may be displayed on a display easily viewable by more than the individual player, as by using a display (e.g., referred to as the public display) that is above the stations of the bank of players, viewable by the one player, each and every one of the players at the bank of stations, and by passersby and other public viewers without interfering with the ability of the player to play the game, observe the reels at the station, observe the larger public display, and the like. The bonus display might embody (in keeping with the tone of this disclosure) images of the Three Stooges, with animation, shifting illumination from one Stooge to another, still displays with numbering, and the like. An individual player, having entered the bonus segment, may view and participate in the play of the bonus feature, either on his own monitor or on the public display monitor, or both. For example, the images of the Three Stooges to be selected from may appear on the public display device. The selection of one of the Three Stooges as the play in the bonus feature may be automatic (randomly selected by the apparatus), may be partially random (e.g., the Three Stooges are individually lit in sequence by a moving light or varying light intensity at a speed that does not allow certainty of selection by a player, but allows a player the opportunity to attempt to time the selection of one Stooge from a control panel), or by player control (e.g., the player specifically choosing from among Curly, Larry and Moe as the play of the bonus feature). The selection of a figure that determines the bonus feature may then provide another enterntainment feature. For example, after one character is selected, there may be a typically, humorous but violent interaction among the Three Stooges or any other visual or visual and/audio entertainment feature displayed on the public display device. When a player has attained a bonus play level, that player may have to be qued with other players at that level at a similar time. This may be handled by a common CPU, data processer, hardware, software, circuitry or the like. A separate, special bonus entertainment film clip or animation lasting for moderate lengths of time, for example 1 to 30 seconds, may be provided at the individual player station on an individual station monitor, with a physical slot game or video slot game.

Another feature that may be used with the film strip visual format, or be used in conventional reel gaming apparatus includes novel audio features. Many visually impaired persons would appreciate the ability to play reel gaming apparatus independently. It is a common sight in casinos to see such persons with a spotter to assist them in determining what their screens exhibit, particularly where there may be some strategy involved upon in the play of the game. This type of audio feature is also particularly amenable for use in combination with the film strip presentation of the reel games of the present invention. The audio feature may be included in the signaling of particular amounts of wagers, on the appearance of particular individual symbols or characters on the pay lines, in acknowledging the deposit of different denominations of currency, upon the occurrence of multiple losses or multiple wins, upon cashing out, and the like. Note the distinction between individual symbols or characters generating an audio response, as opposed to the existing video machine capability of signaling particular types of outcomes, as where a video draw poker machine gives at least an audio signal that a hand achieving a sufficient rank for a payout has been achieved in the play of the game (either on the first exposed card, before replacement, or on the hand after cards have been replaced). The ability to provide increased audio indication of the play of the game increases the ability of the slot wagering game to be played more independently by the visually impaired.

The following types of signals could be provided for the wagering apparatus that would increase accessability to the apparatus, possibly rising to a level of play indication that the visually impaired could independently play the device. Among the independent audio features would be the provision of independent audio signals identifying the 1) availability of the apparatus to start a new wagering game, 2) presence of bet credits, 3) amount of bet credits available, 4) number or amount of bet credits wagered or coins or token wagered, 5) revelation of particular symbols, 6) position of particular symbols, 7) size of any payout, 8) denomination of currency deposited, 9) signalling a loss, 10) signalling multiple losses or wins, and other options that are described herein or become apparent to the ordinarily skilled artisan from a review of this patent. Some of these audio signals are generic to all video wagering systems, and some would be desirable or useful for only certain types of wagering systems. For example, audio signals 1), 2), 3), 4), 7), 8), 9) and 10) would be particularly relevant to almost all video wagering systems, while signals 5), and 6) would tend to be useful only where symbols may be replaced, as with draw poker video games or reel slot games where one or more reels may be respun after a first result. Particularly embodiments of these features could include, for example only, the following types of audio displays:

1) Availability of the apparatus to start a new wagering game could be provided by a unique tone, unique music, recorded announcement, recorded phrases or the like that are thematically related to the game. These announcements would be repetitive, with timed spacing between the announcements so as to minimize annoyance of a player. For example, the machine could have Moe announcing "Put up or shut up!" or any other phrases compatible with the Three Stooges' level of humor. A buzzer could also go off every thirty seconds (or more or less frequently) to announce the availability of the apparatus.

2) The presence of bet credits could be announced by a unique tone, unique music, recorded announcement, recorded phrases or the like that are thematically related to the game. The phrasing could include one of the Three Stooges stating "There's Gold in them Thar hills!" or some equally inappropriate statement.

3) The amount of bet credits available could be announced by a unique tone, unique music, recorded announcement, recorded phrases or the like that are thematically related to the game. It would be particularly desirable to provide an announcement of actual amounts, in a manner similar to automated announcements of telephone numbers, where a chip has the available sounds of all numbers, and either automatically or by pressing an activating button, the number of coins is announced, possibly with a thematic introduction, such as Groucho Marx stating, "That's the most ridiculous thing I ever hoid! You have 1–4–7 credits!"

4) The number or amount of bet credits wagered or coins or token wagered a unique tone, unique music, recorded announcement, recorded phrases or the like that are thematically related to the game. This feature actually lends itself to more variety and entertainment value. Because there are to be at least two, usually up to or at least 5 difference wager levels, there are and must be at least two and usually up to or at least 5 different signals. Different sounds or phrases may be used for each value wagered. For example, with a single token or credit wagered, Curly could be heard saying "Nyuk, nyuk, nyuk!" With two coins wagered, Moe could be heard saying "I ought'a!" With three, four or five tokens wagered, different phrases or sounds should be provided. Video displays could also be provided in association with any of these sounds, such as Moe's statement "I ought'a!" could be accompanied by him pummeling one of the other Stooges. That video feature would not, however, enhance play for the visually impaired, but would enhance the entertainment value to sighted players.

5) The revelation of particular symbols, particularly wild cards, could be accompanied by a unique tone, unique music, recorded announcement, recorded phrases or the like that are thematically related to the game. In a Marx Bros thematic video game, for example, a harp could play or a horn blown to indicate the revelation of a wild card or a special card in the play of the video game. For example, where the jackpot in the play of the video game includes consecutive pictorial representations of Curly, Moe and Larry, the appearance of one, two or three of those figures on or off a play line on the screen could be announced by the signal as the symbols appear or after the game outcome is completely revealed. This would be particularly valuable where an additional reel spin or discard or replacement of a symbol is available on the game.

6) The announcement by signal of a position of particular symbols could be done similarly to the signals for 3) and 5). The variation with regard to 3) is that there would be prerecorded phrases of left, center, right, first pay line, second pay line, third pay line, etc. available for use in the signal, as well as an identifier for the symbol. A specific identifier for a symbol is not needed where the position of a symbol is unique. For example, where Curly may be shown only on reel 1, Moe only on reel 2 and Larry only on reel 3, it would be sufficient to identify payout line 2, reel three to identify the location of Larry. The recordings would be preferably provided by electronic recordation as with a chip.

7) The size of any payout could be announced by a unique tone, unique music, recorded announcement, recorded phrases or the like that are thematically related to the game.

8) The denomination of currency deposited (e.g., differentiating between quarters, $1, $2, $5, $10, $20, $50, $100, etc.) would trigger played of a recorded message such as "That was a twenty spot you just threw to the winds," or a chime particularly indicative of a twenty dollar bill. If a credit or debit card swipe is provided, a sound recording indicative of the amount registered or wagered or a sound indicative of the amount wagered or a sound chosen to correspond to a credit card wager could be played.

9) It might be desirable to provide sounds that are associated with a loss, such as a "Zonk!" or a "Whammy!" or a "Ha-Ha!" or "Sorry! Try again!" at the conclusion of play.

10) It might be desirable to provide sounds that are associated with a predtermined number of losses, such as "Wake up!" or "Too Bad!—Better Luck next time!" or the like: Such sound bites are likely to increase the entertainment value of a game and increase the player's interest in continuing with play.

Another aspect of the present invention could include a unique method for scoring and participating in a video wagering game. The preferred method can be used to play and/or score virtually any video wagering game having at least two distinct playing segments. Although the method of the present invention is preferably used to score rel slot games, the method can be applied to virtually any segmented game where winning outcomes can be determined in advance, and at least one predetermined condition in the first segment can be identified in order to qualify the player to advance to the second segment of the game.

An aspect of the present invention contemplates a mandatory second wager requirement to participate in the second segment of the game, the second wager being required to come from at least a portion of an award from a preceding segment and payout from a preceding segment (or in the case of the play of a third segment, from the earlier played first and second segment). When the play in the second segment is mandatory, the award from the first segment may be used so that it is not at risk. For example, a multiplier may be used in the second screen format which is always 1.0 or larger.

Figure 3:
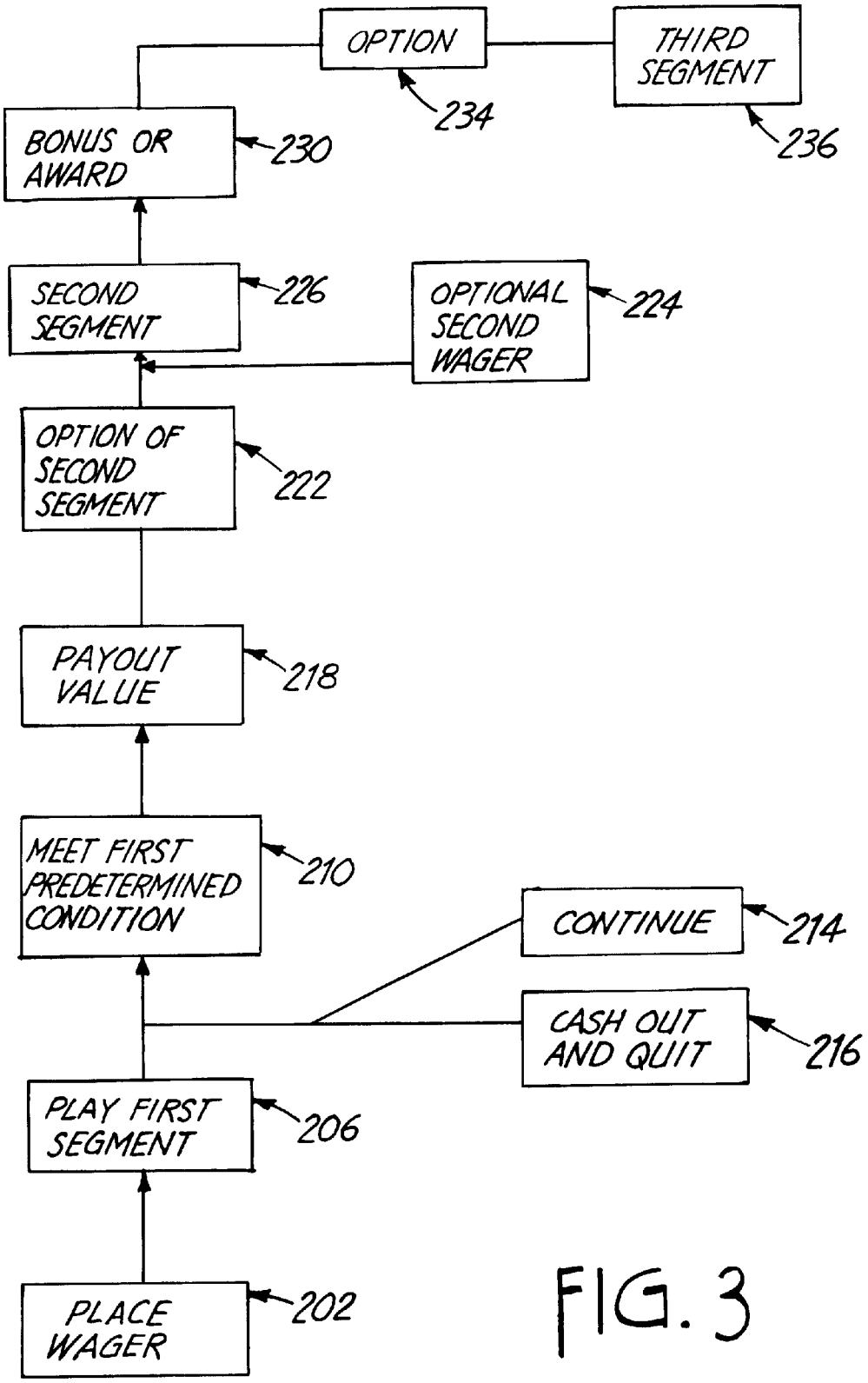
FIG. 3 shows a flow diagram of one method of the present invention.

A flow diagram of the method of the present invention is shown in FIG. 3. A player places a wager 202 to participate in a first segment of a video wagering game. The player first plays the first segment 206 of the video wagering game. If at least one predetermined condition 210 has been met, a payout value 218 is assigned to the play of the first segment of the game 206. Preferably, the player must repeat the wagering 202 and playing 206 steps a number of times before the predetermined set of conditions 210 has been met. The payout on the last game played is not automatically deposited or dumped into a credit account, as at least a portion of the immediate award must be carried forward into the next segment as a mandatory wager. Although it is preferred that the player continue to place wagers with each round of play of the first segment, the present invention contemplates placing only one wager 202 in the first segment and then carrying forth at.least a portion of any award from the first segment into play of a second segment. Between play of each number of the first segment 206, the player has the option to continue 214, or cash out and quit 216. Of course, if the player does not have any credits remaining, the player simply quits playing the first segment 206.

According to one game method, when the player has achieved a predetermined number (including one outcome) of winning outcomes, the predetermined set of conditions has been met 210. When the set of predetermined conditions has been met 210, a payout value is assigned 218 to at least one predetermined winning outcome from the play of the first segment 206. Preferably, the last predetermined winning outcome is the basis for assigning a payout value 218, although a cumulative award basis or partial accumulated award basis (e.g., all of the awards leading to the predetermined winning outcome, the last two hands, the last five hands, the largest award in the last selected number of hands, etc.) may be used.

Next, the player preferably exercises an option 222 of participating in the next segment of the game. Alternatively, play of the next segment is mandatory. The player determines the amount or portion of the assigned payout value 218 which is to be wagered in the play of a second segment 226 or a portion of which is to be credited to the player for a cash out 216. In one embodiment of the present invention, the player may elect to place the entire award as a wager in the second segment, place a portion of the award as a wager in the second segment and accept the remaining portion as a credit, but may not receive the entire award as a credit for play in the first segment 202 and 206. This last restriction may be voided or prevented where the first award does not reach a minimum threshold multiple of the initial wager. For example, the player may retrieve a one-to-one award, but must wager a portion of all awards with payouts of at least three-to-one, at least five-to-one, at least eight-to-one and the like. In that event, the player may retrieve or wager the award or part of the award in the second segment. There may or may not be an additional wager 224 required to participate in the play of the second segment, in addition to advancing a portion of the award from the play of the first segment. The optionally provided additional wager 224 mayor may not influence the payout potential of the second segment, as in initiating a fixed award jackpot or progressive jackpot entry. The present invention contemplates providing an optional or required second wager to participate in the second segment. It is to be understood that the second wagering event might necessitate modifying the preferred pay tables of the present invention. That is, because the second segment influences the total amount of award which may be available from a single unit of wager, the pay tables in the first segment may significantly vary from standard pay tables of a similar game, offering either higher awards or lower awards for a given outcome.

At the conclusion of play of the second segment 226 which has a visually different screen format than play of the first segment 206, an award or factor is identified and the level of payout, bonus or award is determined from the second segment of play 230. The terms "payout" and "award" or "bonus" have related meanings. The payout is usually intended to mean the number of wager credits or coins to be returned to the player from the results of play. An award may include the payout, but may also include potentially non-monetary elements such as the right to proceed to another segment, a display of entertainment value such as playing a film clip from a movie, or the accumulation of credits towards play in a special segment for a jackpot or progressive jackpot. For example, in the play of the first segment, if the payout is only an equal value award, there may be no right to advance to a second segment, while if the payout is at least three times the wager, there may be an award of an opportunity to advance to a second (or further) segment play, carrying at least a portion of the award forward as the wager in the next segment. A bonus may be in addition to a payout and award, and may have a monetary or nonmonetary value towards play or amounts towards a particular payout or jackpot. For example, after play has been enabled in a second or further segment, bonus values may be awarded for particular results in the play, and these bonus values may be carried forth in search of a particularly high payout, factored payout or jackpot. An option 234 may be provided to the player to convert the bonus values to free plays of the first segment or to advance to a third segment 236 (with the same or visually different screen format).

In a second example of the invention, the player may choose to play a second segment of the game in a different screen format. Preferably, entire awards from the last game of the first segment are placed at risk when there is an option to engage play in the second segment. Alternatively, only a portion of the award may be placed at risk, or the bonus round may not require that any award from the first segment be put at risk. Thus, all or only a portion of the award from the first screen may be wagered in the play of the second segment on a different screen format.

According to one aspect of the present invention, payouts from the first segment may be enhanced by multiplying the assigned payout value by a multiplication factor, hereinafter referred to simply as a "factor" or by allowing the player to wager part or all of the payouts from the first segment in a separate game which may offer the opportunity to multiply or otherwise increase the payouts in a different formatted screen and different game. Where there are significantly large awards possible in the play of second or other subsequent segments, there should be a risk to the initial award involved in the play of the second segment. Preferably with more moderate award effects (e.g., increasing the award by fixed amounts such as five tokens or credits, or by multiples of less than five), the factor is always an integer equal to or greater than one, or to add a little tension to play of the game, at least one potential outcome is for the factor to be a positive value above zero but below one. In other words, the player is not putting the entire payout of the first segment at risk by participating in play of the second segment. This unique feature adds fun and enjoyment to the game. Since there may even be no risk in participating in the second segment, there is really no reason why the player would choose not to participate. In fact, in the example described below, participation in the second segment is required.

Figure 4:
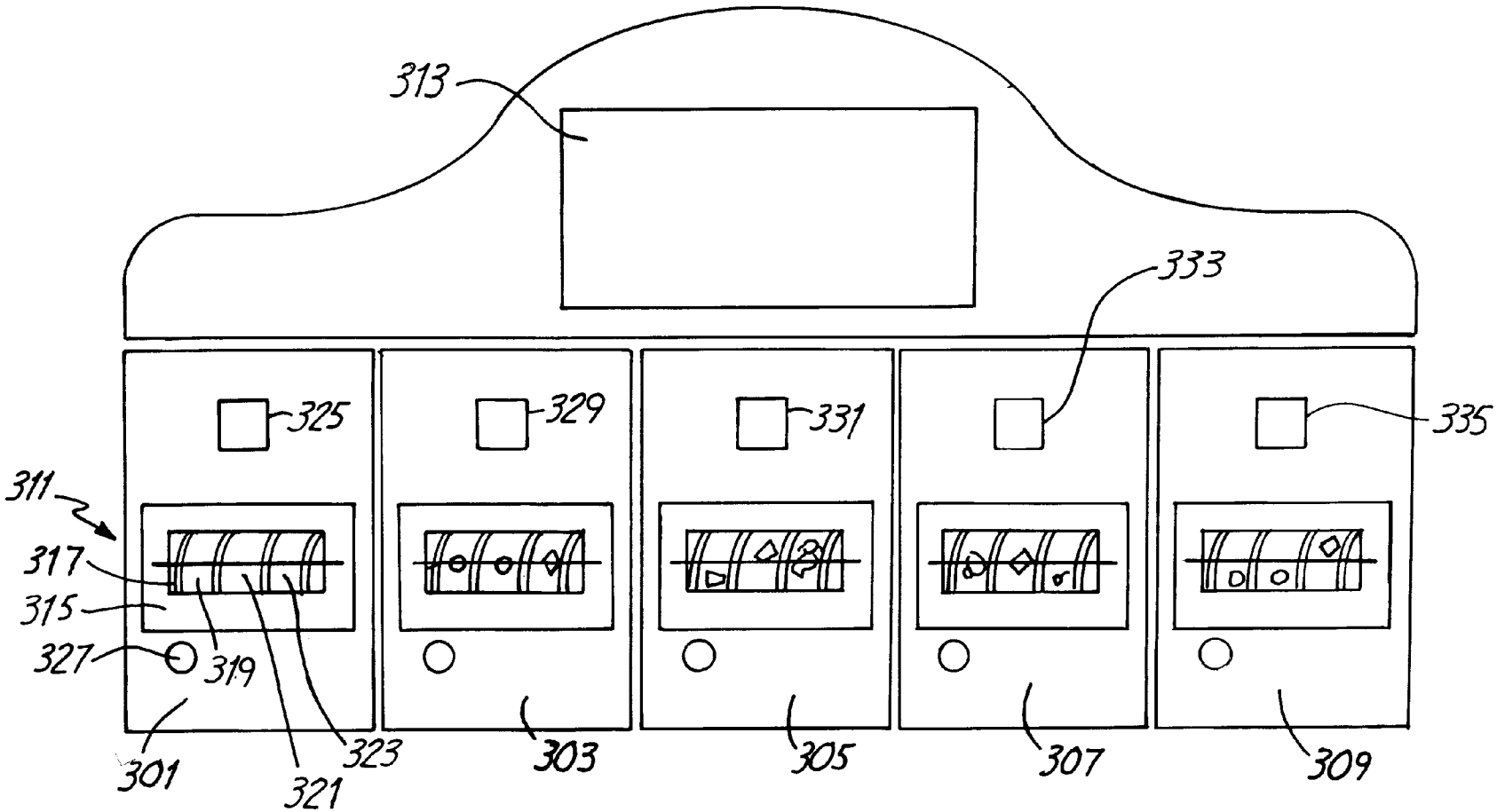
FIG. 4 shows a bank of reel slot machines according to the present invention.

FIG. 4 shows a bank of gaming machines according to the present invention. According to an aspect of the present invention, a plurality of reel slot machines 301, 303, 305, 307 and 309 are illustrated in FIG. 4. The slot machines are arranged in a bank 311 and share a common or public bonus display 313 that may be, for example, a plasma display, CRT, Liquid crystal display, projected image, reflected image, or the like. Each slot machine in the bank 311 is essentially identical (although some variations such as different pictures of Three Stooges or the like may be on the various machines) so that the discussion with respect to machine 301 generally applies to the remaining machines in the bank 311. The slot machine 301 preferably includes a reel display 315, which includes a window 317 revealing a plurality of spinning reels 319, 321 and 323. Each reel 319, 321 and 323 is equipped with a reels strip bearing an image of a film strip surrounding, overl;aying, or otherwise associated with each reel symbol (that is the symbols may also extend beyond the borders of the frames, either under or over the border image), creating the appearance of a film strip.

Each machine 301 is also equipped with a separate video display 325 that can be the same display as reel display 315 if the segment of the game is a video reel game rather than a conventional reel game (physical reel game).

The video display 325 serves several functions or potential functions. The display is preferably used for pure entertainment, e.g., to play film clips, display messages or to display other visual images, such as when celebrating a winning outcome.

If the player wins a bonus prize in the second segment, peferably an additional entertainment feature is displayed on the common display 313 or each of the video displays 325, 3239, 331, 333 and 335 or all of the above. This entertainment feature can be in the form of a film clip from a movie such as a Three Stooges movie, with or without celebration music, animation on the screen (such as confetti dropping or fireworks, ballons rising, and the like) and/or messages in the form of words such as "Big Winner!" etc.

Preferably all players participating in the first segment of the reel game are eligible to play the second segment or second bonus game. Preferably only one player can play the bonus game at a time. Once a player achieves an outcome on the first game that qualifies the player to particpate in the bonus game, his or her machine may switch into an idle mode, and the player is put into a cue for the bonus round.

Preferably the video display 325 provides the player with a visual indication that the gaming machine is idle and the order in which players will play the bonus game. When it is the player's turn to play the bonus round, preferably the bonus display 313 displays a number of images, such as Larry, Curly and Moe. The player hits button 327 on the player console to randomly select a Stooge.

Preferably, an additional segment includes a Stooge performing an act that randomly assigns the player bonus points. In this embodiment, the event that triggers the bonus feature is obtaining the "bonus Stooge" symbols on a pay line and winning a payout. The winnings from the reel game may not have to be placed at risk in the bonus game, and preferably are not placed at risk.

Figure 5A:
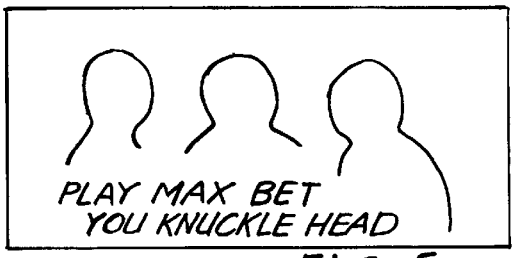
FIGS. 5*a*), *b*), *c*), *d*), *e*), *f*), *g*) and *h*) show a thematically continuous series of second segments that can be used in the play of the second segment in a practice of the present invention.
Figure 5B:
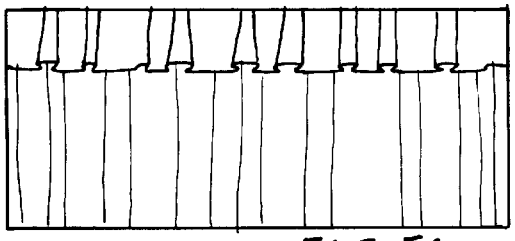
Figure 5C:
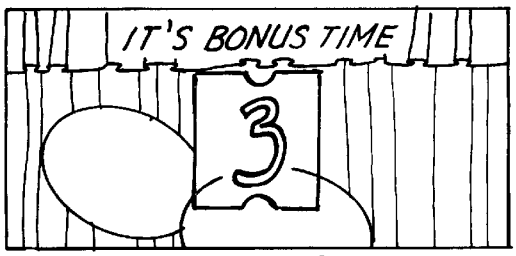
Figure 5D:
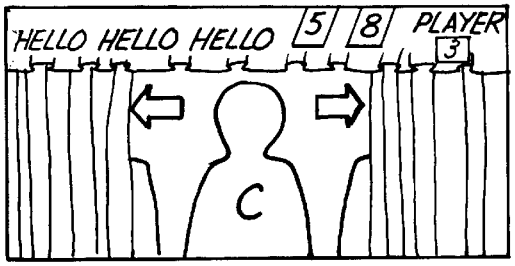
Figure 5E:
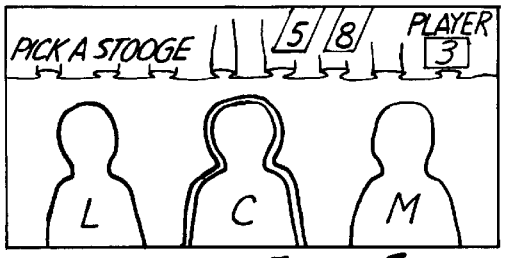
Figure 5F:
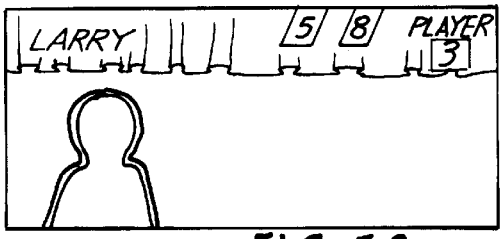
Figure 5G:
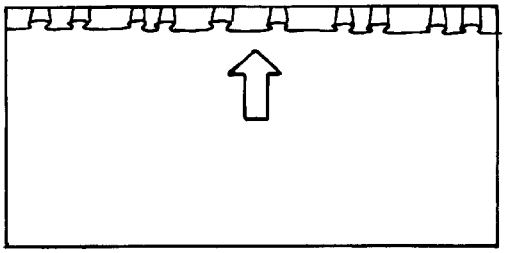
Figure 5H:
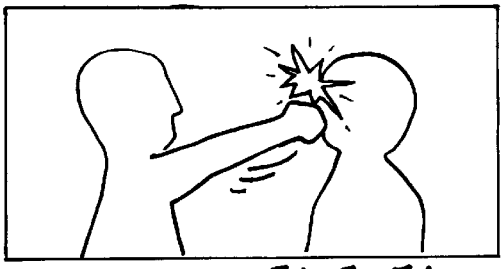

FIGS. 5*a*), *b*), *c*), *d*), *e*), *f*); *g*) and *h*) show a thematically continuous series of second segments that can be used in the play of the second segment in the practice of the present invention. FIG. 5*a*) shows the Three Stooges in a stage scene or screen scene. This feature could attract a player to place the maximum bet or the largest portion of his winnings in the play of the first segment or the second segment, with printed and/or audio messages, such as "Place the maximum bet, you knucklehead!" Alternatively or in alternating format, FIG. 5*b*) shows a closed curtain for an idle mode, or an indication that the player has not qualified for bonus play. In FIG. 6*c*), after a bonus has been achieved in the play of a first segment, the curtain may be highlighted or overlain with words and/or accompanied by audio portions, such as "It's Bonus Time!" In one particularly desirable type of play, the curtain may open, displaying the Three Stooges, one-at-a-time, for example, with each of the Stooges greeting the player in their own voices or imitations of their voices, for example, merely saying "Hello!" or making some other form of greeting (including insults) as shown in FIG. 5*d*). FIG. 5*e*) shows three different figures of each of Three Stooges, from which the player may select any one figure to play the second segment. There may be banter of physical interaction on the screen among the Three Stooges, such as "Pick me!" or "Hit the Spin Button" to enact selection of one of the figures in the second feature. When one of the Figures is selected, that figures name may be called out or that particular Stooge identified, as by the other Stooges insulting him, with the selected figure particularly identified in FIG. 5*f*). The screen may then undergo a transition (e.g., shown in FIG. 5*g*)) to a bonus "violence" event, shown in FIG. 5*h*). By violence event is meant that the figures, as is representative of the humor of the Three Stooges undertake specific types of physical attacks or actions against other characters, including, but not limited to the other Three Stooges. A movie clip of the Three Stooges from one of their movies could be played for a sufficient time to enable entertainment of the player, such as from 2 to 20 seconds, or from 3–15 seconds or from 3 to 12 seconds, or the like.

Figure 6A:
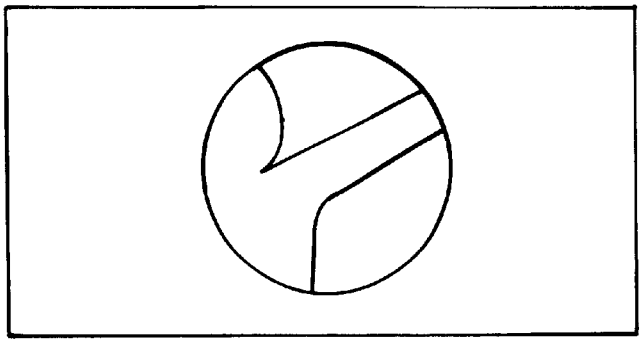
FIGS. 6*a*), 6*b*), 6*c*) and 6*d*) show additional screen features that may be available.
Figure 6B:
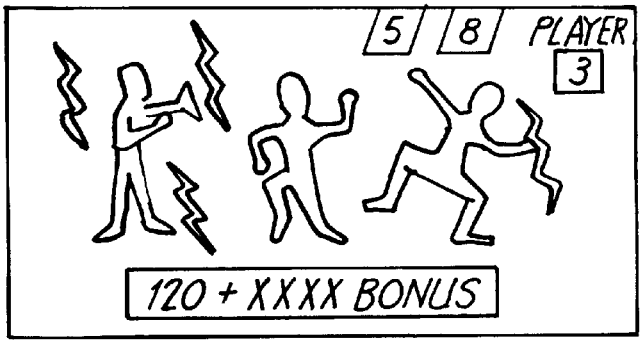
Figure 6C:
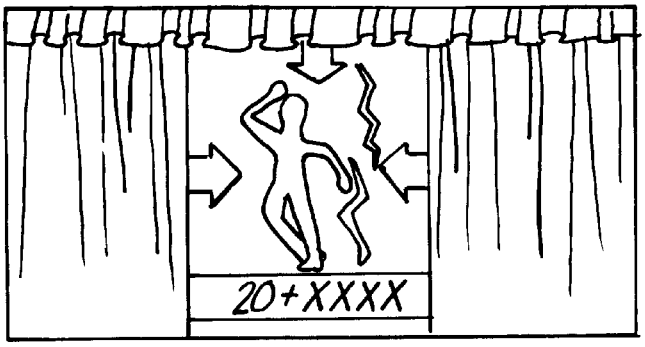
Figure 6D:
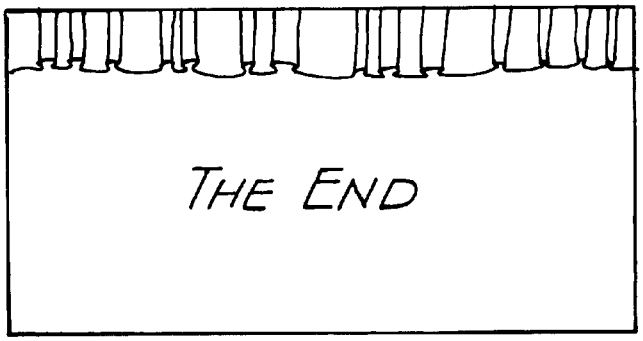

Additional screen features may be available, such as those exemplified in FIGS. 6*a*), *b*), *c*) and *d*). FIG. 6*a*) shows a screen wiping function, such as a circle wipe that cleans the screen of the bonus violent event at the conclusion of this segment of the game. If the player wins a bonus payout, the celebration display shown in FIG. 6*b*) may be displayed, where figures, such as the Three Stooges, are shown dancing, with a display of the amount of the special bonus. The celebration display in FIG. 6*b*) may end with the curtain slowly closing on the display, as shown in FIG. 6*c*). The celebration may terminate with the closed curtain display shown in FIG. 6*d*), with or without a overlay statement such as "The End" or "Finis."

What is claimed:

1. A reel slot casino wagering apparatus comprising a housing having at least three displayed reels thereon, each reel having symbols, characters or alphanumerics that are displayed, a wager entering system, a CPU and a sound system, wherein the CPU has software and/or hardware that provides distinctly different audio signals for at least one of 1) availability of the apparatus to start a new wagering game, 2) presence of bet credits, 3) amount of bet credits available, 4) number or amount of bet credits wagered or coins or token wagered, 5) revelation of a non-payout configuration, 6) position of only particular symbols where the total configuration of all symbols does not provide a payout, 7) size of a payout inclusive of payouts for non-jackpot awards, 8) denomination of currency or credits deposited, and 9) denoting one or more game losses.

2. The reel slot wagering apparatus of claim 1 wherein distinctly different sound are provided for at least two different levels of wagers.

3. The reel slot wagering system of claim 1 wherein a distinct sound is provided for the revelation of a symbol, character or alphanumeric associated with qualifying to play a bonus or jackpot when that symbol character or alphanumeric is not included in a combination of symbols, characters or alphanumerics that is a losing outcome.

4. The apparatus of claim 1 wherein the apparatus comprises a housing having at least two displayed reels therein, each reel having symbols, characters or alphanumerics on an outer surface of the reel that are displayed as frames, wherein combinations of frames define game outcomes, at least some of the frames having borders as images on the reels that surround the symbols, characters or alphanumerics.

5. The apparatus of claim 1 wherein the apparatus comprises a housing having at least two displayed reels therein, each reel having symbols, characters or alphanumerics on an outer surface of the reel that are displayed as frames representing a motion picture film frame.

6. The reel slot wagering apparatus of claim 2 wherein the different sounds comprise spoken phrases.

7. The reel slot wagering apparatus of claim 6 wherein the different sounds comprise spoken phrases of characters that are pictorially represented on the wagering apparatus.

8. A reel slot casino wagering apparatus comprising a housing having at least three displayed reels thereon, each reel having symbols, characters or alphanumerics that are displayed, a wager entering system, a CPU and a sound system, wherein the CPU has software and/or hardware that provides distinctly different audio signals for each different subunit from among the sets consisting of 1) availability of the apparatus to start a new wagering game, 2) presence of bet credits, 3) amount of bet credits available, 4) number or amount of bet credits wagered or coins or token wagered, 5) revelation of particular symbols in a non-payout configuration, 6) position of particular symbols where the total configuration of all symbols does not provide a payout, 7) size of a payout including payouts for non-jackpot awards, 8) denomination of currency or credits deposited, and 9) denoting one or more game losses.

9. The apparatus of claim 8 wherein the apparatus comprises a housing having at least two displayed reels therein, each reel having symbols, characters or alphanumerics on an outer surface of the reel that are displayed as frames, wherein combinations of frames define game outcomes, at least some of the frames having borders as images on the reels that surround the symbols, characters or alphanumerics.

10. A reel slot casino wagering apparatus comprising a housing having at least three displayed reels thereon, each reel having symbols, characters or alphanumerics that are displayed, a wager entering system, a CPU and a sound system, wherein the CPU has software and/or hardware that provides distinctly different audio signals for at least one of 1) availability of the apparatus to start a new wagering game, 2) presence of bet credits, 3) amount of bet credits available, 4) number or amount of bet credits wagered or coins or token wagered, 5) position of particular symbols where the total configuration of all symbols does not provide a payout, 6) size of a payout inclusive of payouts for non-jackpot awards, 7) denomination of currency or credits deposited, and 10) denoting one or more game losses.

* * * * *